US008166958B2

(12) United States Patent
Rice et al.

(10) Patent No.: US 8,166,958 B2
(45) Date of Patent: May 1, 2012

(54) POSITIVE CRANKCASE VENTILATION SYSTEM FOR AN INTERNAL COMBUSTION ENGINE

(75) Inventors: Alan E. Rice, New Baltimore, MI (US); Robert J. Moran, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 784 days.

(21) Appl. No.: 12/046,654

(22) Filed: Mar. 12, 2008

(65) Prior Publication Data

US 2009/0044791 A1 Feb. 19, 2009

Related U.S. Application Data

(60) Provisional application No. 60/955,984, filed on Aug. 15, 2007.

(51) Int. Cl.
*F01M 13/04* (2006.01)

(52) U.S. Cl. ..... 123/572

(58) Field of Classification Search ..... 123/572–574
See application file for complete search history.

(56) References Cited

U.S. PATENT DOCUMENTS

| | | | | |
|---|---|---|---|---|
| 4,651,704 | A * | 3/1987 | Sekiguchi | 123/572 |
| 5,261,380 | A * | 11/1993 | Romano | 123/573 |
| 6,584,964 | B1 * | 7/2003 | Seilenbinder et al. | 123/572 |
| 6,783,571 | B2 * | 8/2004 | Ekeroth | 95/8 |
| 7,309,308 | B2 * | 12/2007 | Berger et al. | 494/81 |
| 7,717,101 | B2 | 5/2010 | Beetz et al. | |
| 2002/0083933 | A1 * | 7/2002 | Schmid et al. | 123/572 |

FOREIGN PATENT DOCUMENTS

| | | | |
|---|---|---|---|
| JP | 2005291041 | A | 10/2005 |
| WO | 2006119737 | A1 | 11/2006 |

* cited by examiner

*Primary Examiner* — M. McMahon
(74) *Attorney, Agent, or Firm* — Quinn Law Group, PLLC

(57) ABSTRACT

A positive crankcase ventilation (PCV) system is provided for an internal combustion engine. The PCV system includes a centrifugal separator disposed within a shaft member, for example a balance shaft, of the internal combustion engine. The centrifugal separator is operable to impart rotational motion on the gases flowing through the shaft member such that the centrifugal forces urge the separation of oil particle entrained within the gases.

14 Claims, 3 Drawing Sheets

POSITIVE CRANKCASE VENTILATION SYSTEM FOR AN INTERNAL COMBUSTION ENGINE

CROSS-REFERENCE TO RELATED APPLICATIONS

This application claims the benefit of U.S. Provisional Application 60/955,984, filed Aug. 15, 2007, which is hereby incorporated by reference in its entirety.

TECHNICAL FIELD

The present invention relates to positive crankcase ventilation systems for use with internal combustion engines.

BACKGROUND OF THE INVENTION

Positive crankcase ventilation (PCV) systems have been used within internal combustion engines to reduce emission of contaminants by recirculating blow-by gases and crankcase vapors, or PCV gases, into combustion chambers of the internal combustion engine for subsequent burning therein. This is commonly accomplished by conducting the PCV gases from a crankcase defined by the internal combustion engine into an intake system or intake manifold where it is subsequently drawn into the combustion chambers. If the gases are drawn into an intake manifold, a PCV valve is generally required to control the amount of gas flow because the manifold vacuum varies greatly and generally inversely to the amount of PCV gases required to be recirculated. However, where the PCV gases are recirculated into the air intake system, it has been generally satisfactory to control the gas flow by means of an orifice.

The gases which enter the PCV system from the crankcase and flow to the combustion chambers can have oil particles suspended therein. The oil particles can travel through the PCV system, with the PCV gases, to the intake system and combustion chambers in which they are burned with the air and fuel. If the amount of such oil particles becomes excessive, the engine emissions and oil consumption can increase. Therefore, PCV systems can include a filter device for separating oil particles from the gases to reduce the amount of oil which flows to, and is burned within, the combustion chambers. Such a filter device can include a semi-permeable filter element through which the PCV gases flow. The filter element typically has small openings or interstices through which the PCV gases, and the oil particles contained therein, must pass. The openings are sufficiently sized so that the oil is strained from the PCV gases and remains in the filter element. The filter element can become clogged with oil and thereby obstruct the gas flow therethrough. An additional consideration is freezing or icing of the PCV system in cold climates. Condensed water in the PCV system can gather and freeze, obstructing the gas flow or allowing icing of intake system components. Mounting the PCV system components internally to the engine will reduce the risk of icing.

SUMMARY OF THE INVENTION

A positive crankcase ventilation (PCV) system is provided for an internal combustion engine having an engine block defining a crankcase volume containing gases and oil particles suspended therein. The PCV system includes a shaft member rotatably supported within the engine block and defining a generally cylindrical cavity extending longitudinally within the shaft member. The shaft member further defines at least one orifice operable to communicate the gases and oil particles from the crankcase volume to the generally cylindrical cavity.

A cover member is removably mounted to the engine block and is operable to enclose at least a portion of the shaft member. The cover member at least partially defines a PCV feed passage and an oil drain passage. A hollow tube member is formed on the cover member and at least a portion of the tube member is coaxially received within the generally cylindrical cavity of the shaft member to define an outer region and an inner region of the generally cylindrical cavity. The outer region is in communication with the oil drain passage and the inner region is in communication with the PCV feed passage.

A centrifugal separator is disposed within the generally cylindrical cavity and is operable to effect rotation of the gases and oil particles within the generally cylindrical cavity. At least a portion of the oil particles are forced to the outer region of the generally cylindrical cavity by the centrifugal separator for communication to the oil drain passage. Additionally, at least a portion of the gases are communicated from the inner region to the PCV feed passage.

The above features and advantages of the present invention are readily apparent from the following detailed description of the best modes for carrying out the invention when taken in connection with the accompanying drawings.

DESCRIPTION OF THE PREFERRED EMBODIMENTS

Figure 1:
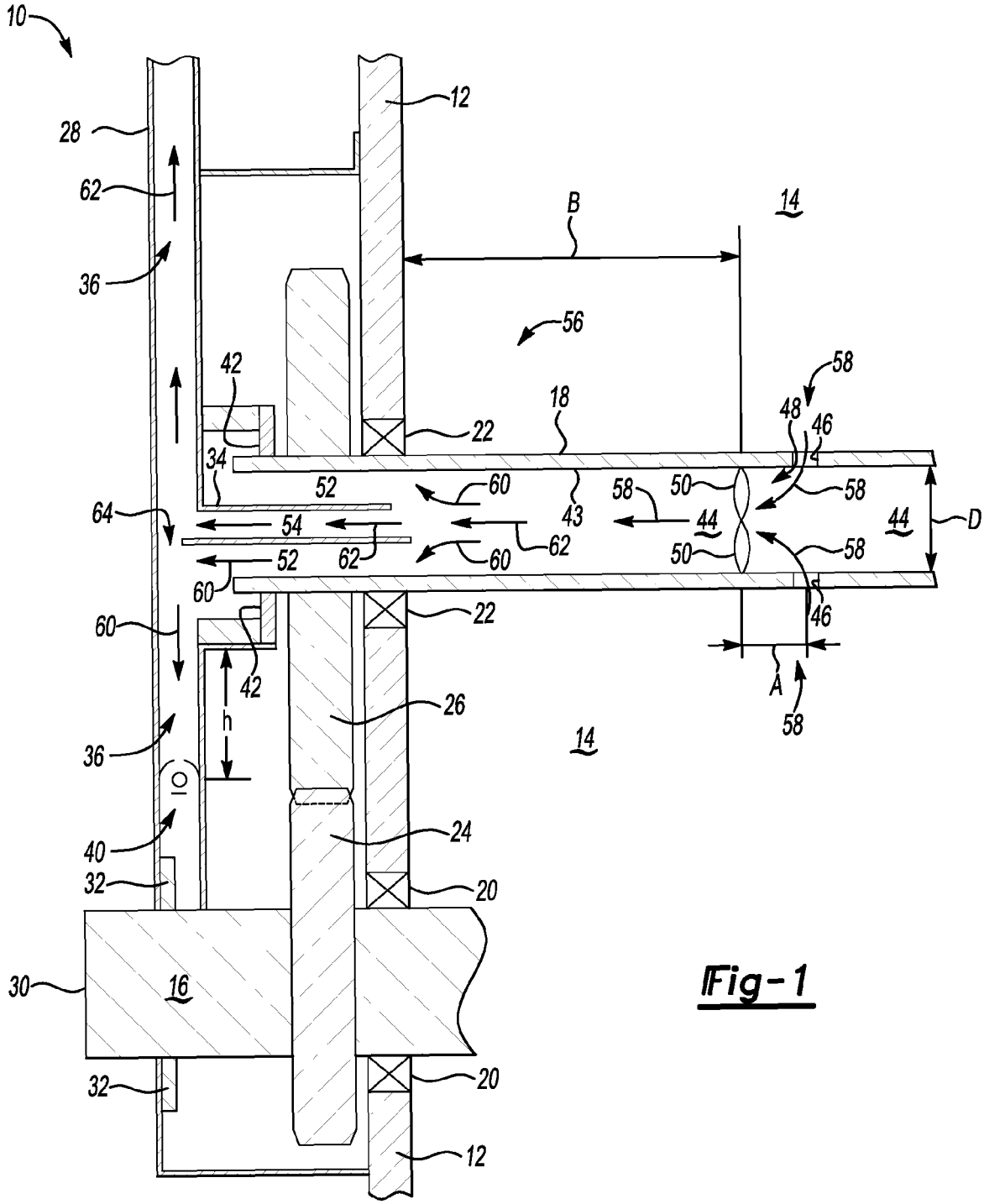
FIG. 1 is a schematic diagrammatic representation of a portion of an internal combustion engine having a positive crankcase ventilation system incorporating a centrifugal separator within a balance shaft of the internal combustion engine.

Referring to the drawings wherein like reference numbers correspond to like or similar components throughout the several views there is schematically depicted in FIG. 1 a portion of an internal combustion engine, generally indicated at 10. The internal combustion engine 10 includes an engine block 12 at least partially defining a crankcase volume 14. The internal combustion engine 10 further includes a crankshaft 16 and a shaft member 18, for example a balance shaft. The crankshaft 16 and the shaft member 18 are rotatably supported within the engine block 12 by respective first and second bearings 20 and 22.

A first gear member 24 is mounted to the crankshaft 16 for unitary rotation therewith, while a second gear member 26 is mounted to the shaft member 18 for unitary rotation therewith. The first and second gear members 24 and 26 are meshingly engaged with one another to maintain rotational timing between the crankshaft 16 and the shaft member 18. Those skilled in the art of engine design will recognize other means for maintaining rotational timing between the crankshaft 16 and the shaft member 18, for example a chain drive system.

A cover member 28 is removably mounted to the engine block 12 and is operable to partially enclose the shaft member 18. An end portion 30 of the crankshaft 16 extends through the cover member 28. A rotary seal 32, such as a lip seal, is mounted to the cover member 28 and is operable to sealingly engage the end portion 30 of the crankshaft 16 to effect sealing of the crankcase volume 14. The cover member 28 is preferably formed from cast metal or composite material and includes a tube member 34 extending therefrom. The cover member defines a positive crankcase ventilation (PCV) feed passage 36 and an oil drain passage 38. The oil drain passage 38 includes a one-way check valve 40. A rotary seal 42 is mounted to the cover member 28 and sealingly engages the shaft member 18.

The shaft member 18 includes an inner wall 43 which defines a generally cylindrical cavity 44 that extends longitudinally along the shaft member 18 and has a diameter, indicated as D in FIG. 1. The shaft member 18 further defines orifices 46 that extends radially inward. A vortex or centrifugal separator 48 is disposed within the generally cylindrical cavity 44. The centrifugal separator 48 includes a plurality of blades or vanes 50. At least a portion of the tube member 34 is received within the generally cylindrical cavity 44. The tube member 34 is positioned coaxially within the generally cylindrical cavity 44, as such; the tube member 34 is operable to divide the cylindrical cavity 44 into an outer region 52 and an inner region 54.

The shaft member 18, centrifugal separator 48, and the cover member 28 cooperate to form a portion of a PCV system, generally indicated at 56. During operation of the internal combustion engine 10, the PCV system 56 is effective to introduce gases, indicated by arrow 58, from within the crankcase volume 14 into a combustion chamber (not shown) of the internal combustion engine 10 for combustion therein. The gases 58 may include air and blow-by gases.

Additionally, the gases 58 typically include an amount of oil entrained therein. To maintain low exhaust emissions and oil consumption, it is desirable to remove the oil from the gases 58 prior to introduction to the combustion chamber of the internal combustion engine 10.

The gases 58 enter the PCV system 56 though the orifices 46 defined by the shaft member 18. The gases 58 are subsequently introduced to the centrifugal separator 48 which, by virtue of the rotation of the shaft member 18, is operable to impart rotational motion or swirl to the gases 58. The centrifugal forces exerted on the gases 58 as a result of the rotational motion cause the relatively heavy oil droplets or particles, indicated as arrows 60, to be forced outward toward the inner wall 43 of the shaft member 18, while the relatively light PCV gases, indicated by arrows 62, remain centrally located within the generally cylindrical cavity 44.

At least a portion of the oil particles 60 is introduced to the outer region 52 for subsequent introduction to the oil drain passage 38 to be communicated to the crankcase volume 14. At least a portion of the PCV gases 62 is introduced to the inner region 54 to be communicated to the PCV feed passage 36 for subsequent introduction to the combustion chamber of the internal combustion engine 10.

An orifice 64 is defined by the cover member 28 and is operable to provide communication between the PCV feed passage 36 and the oil drain passage 38. The orifice 64 enables oil particles 60 contained within the PCV gases that have fallen out of suspension within the PCV feed passage 36 to drain through the oil drain passage 38 for reintroduction to the crankcase volume 14. The one-way check valve 40 is operable to allow the free flow of oil particles 60 into the crankcase volume 14, while blocking the entry of gases 58 from within the crankcase volume 14 into the oil drain passage 38.

The orifices 46 are positioned upstream of the centrifugal separator at a distance A, while the centrifugal separator 48 is positioned upstream of the tube member 34 at a distance B. In a non-limiting example embodiment, the distance A will be at least two times the diameter D of the generally cylindrical cavity 44, while the distance B will be at least ten times the diameter D of the generally cylindrical cavity 44. In another example embodiment, the shaft member 18 is disposed within the crankcase volume 14 is a quiescent area or an area of low windage such that the oil entrained within the gases 58 is minimized.

Figure 2:
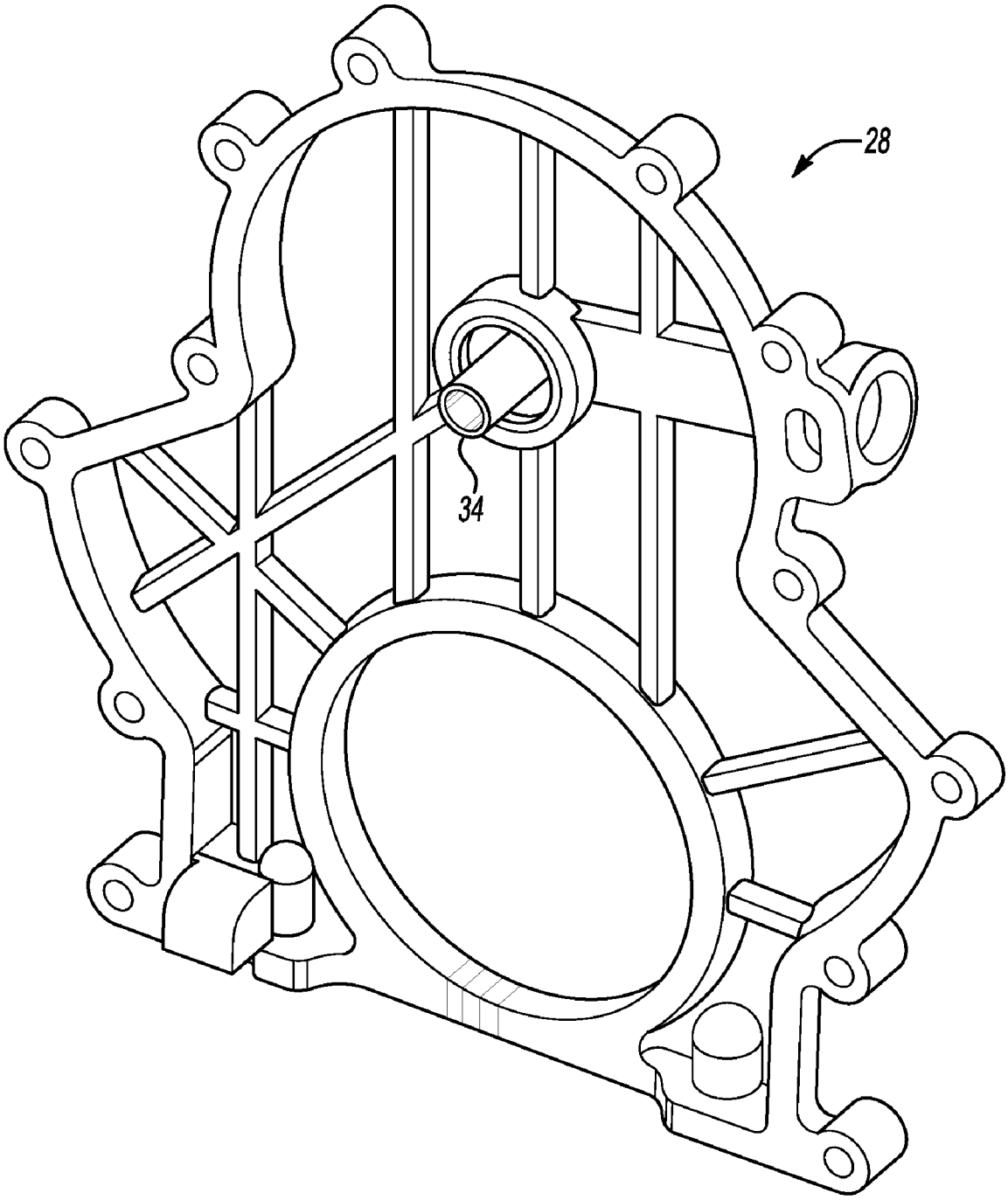
FIG. 2 is a perspective view of an example cover member including a tube member according to the present invention.

Referring now to FIG. 2 and with continued reference to FIG. 1, a perspective view of one example cover member 28 of FIG. 1 is shown. The cover member 28 includes the tube member 34 extending therefrom. Upon assembly of the cover member 28 to the engine block 12, the tube member 34 extends inward from the cover member 28 within the cylindrical cavity 44, as further illustrated in FIG. 3.

Figure 3:
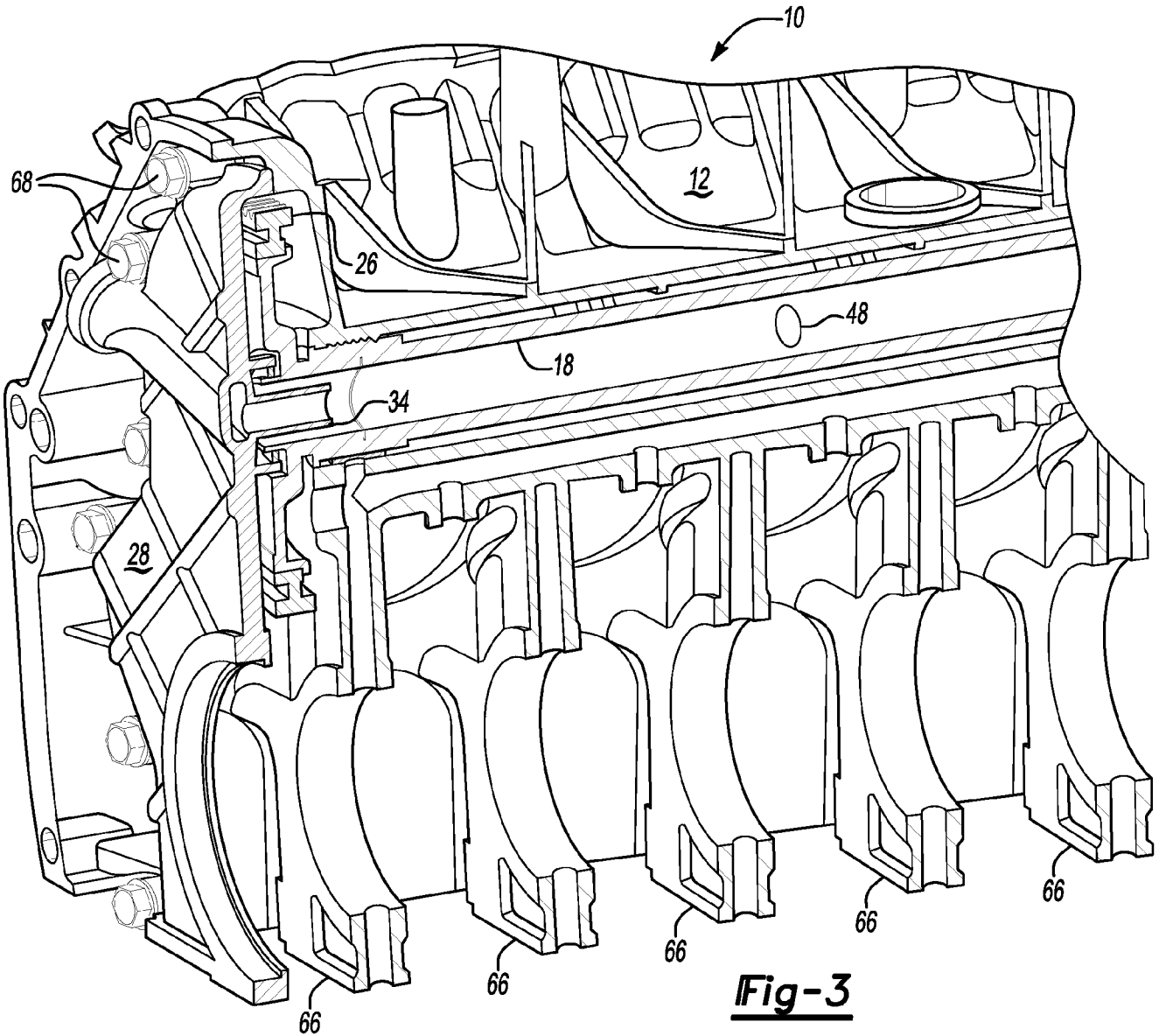
FIG. 3 is an environmental perspective sectional view of the internal combustion engine of FIG. 1 further illustrating components of the positive crankcase ventilation system.

Referring now to FIG. 3, with continued reference to FIGS. 1 and 2, an environmental perspective cross-sectional view of the internal combustion engine 10 of FIG. 1 is shown. The engine block 12 includes a plurality of bulkheads 66 operable to rotatably support the crankshaft 16, shown in FIG. 1. The bulkheads 66 further define the crankcase volume 14. The cover member 28 is removably mounted to the engine block 12 via a plurality of threaded fasteners 68, such as bolts or screws. The tube member 34 of the cover member 28 extends into the cylindrical cavity 44 and is operable to divide the cylindrical cavity 44 into the outer region 52 and the inner region 54 as discussed in FIG. 1.

While the best modes for carrying out the invention have been described in detail, those familiar with the art to which this invention relates will recognize various alternative designs and embodiments for practicing the invention within the scope of the appended claims.

The invention claimed is:

1. A positive crankcase ventilation (PCV) system for an internal combustion engine having an engine block defining a crankcase containing gases and oil particles suspended therein, the PCV system comprising:

a shaft member rotatably supported within the engine block and defining a generally cylindrical cavity extending longitudinally within the shaft member and defining at least one orifice operable to communicate the gases and oil particles from the crankcase to the generally cylindrical cavity;

a cover member removably mounted to the engine block and operable to enclose at least a portion of the shaft member, wherein the cover member at least partially defines a PCV feed passage and an oil drain passage;

a hollow tube member formed on the cover member and at least a portion of the tube member being coaxially received within the generally cylindrical cavity of the shaft member to define an outer region and an inner region of the generally cylindrical cavity, the outer region being in communication with the oil drain passage and the inner region being in communication with the PCV feed passage;

a centrifugal separator disposed within the generally cylindrical cavity and operable to effect rotation of the gases and oil particles within the generally cylindrical cavity;

wherein at least a portion of the oil particles are forced to the outer region of the generally cylindrical cavity by the centrifugal separator for communication to the oil drain passage and at least a portion of the gases are communicated from the inner region to the PCV feed passage.

2. The positive crankcase ventilation system as recited in claim 1, further comprising a one-way check valve disposed within the oil drain passage.

3. The positive crankcase ventilation system as recited in claim 1, further comprising a rotary seal mounted to the cover member and operable to sealingly engage the shaft member.

4. The positive crankcase ventilation system as recited in claim 1, wherein the shaft member is a balance shaft.

5. The positive crankcase ventilation system as recited in claim 1, wherein the at least one orifice is positioned upstream from the centrifugal separator at a distance of at least two times the diameter of the generally cylindrical cavity.

6. The positive crankcase ventilation system as recited in claim 1, wherein the tube member is positioned downstream from the centrifugal separator at a distance of at least ten times the diameter of the generally cylindrical cavity.

7. The positive crankcase ventilation system as recited in claim 1, wherein the at least one orifice extends radially inward.

8. An internal combustion engine including a positive crankcase ventilation (PCV) system, the PCV system comprising:

a shaft member rotatably supported within an engine block, wherein the shaft member defines: a generally cylindrical cavity extending longitudinally within the shaft member and at least one orifice operable to communicate gases and oil particles from a crankcase to the generally cylindrical cavity;

a cover member removably mounted to the engine block, wherein the cover member is operable to enclose at least a portion of the shaft member, and wherein the cover member at least partially defines a PCV feed passage and an oil drain passage;

a hollow tube member formed on the cover member, wherein at least a portion of the tube member is coaxially received within the generally cylindrical cavity of the shaft member to define an outer region and an inner region of the generally cylindrical cavity, the outer region being in communication with the oil drain passage and the inner region is in communication with the PCV feed passage;

a centrifugal separator disposed within the generally cylindrical cavity and operable to effect rotation of the gases and oil particles within the generally cylindrical cavity;

wherein at least a portion of the oil particles are forced to the outer region of the generally cylindrical cavity by the centrifugal separator for communication to the oil drain passage and at least a portion of the gases are communicated from the inner region to the PCV feed passage.

9. The internal combustion engine as recited in claim 8, the PCV system further comprising a one-way check valve disposed within the oil drain passage.

10. The internal combustion engine as recited in claim 8, the PCV system further comprising a rotary seal mounted to the cover member and operable to sealingly engage the shaft member.

11. The internal combustion engine as recited in claim 8, wherein the shaft member is a balance shaft.

12. The internal combustion engine as recited in claim 8, wherein the at least one orifice is positioned upstream from the centrifugal separator at a distance of at least two times the diameter of the generally cylindrical cavity.

13. The internal combustion engine as recited in claim 8, wherein the tube member is positioned downstream from the centrifugal separator at a distance of at least ten times the diameter of the generally cylindrical cavity.

14. The internal combustion engine as recited in claim 8, wherein the at least one orifice extends radially inward.

* * * * *